US007547016B2

(12) United States Patent
Mizuno

(10) Patent No.: US 7,547,016 B2
(45) Date of Patent: Jun. 16, 2009

(54) MOTOR CONTROL APPARATUS WITH CONTROLLED INPUT CURRENT

(75) Inventor: Manabu Mizuno, Toride (JP)

(73) Assignee: Canon Kabushiki Kaisha (JP)

( * ) Notice: Subject to any disclaimer, the term of this patent is extended or adjusted under 35 U.S.C. 154(b) by 548 days.

(21) Appl. No.: 11/228,167

(22) Filed: Sep. 16, 2005

(65) Prior Publication Data

US 2006/0071416 A1 Apr. 6, 2006

(30) Foreign Application Priority Data

Sep. 17, 2004 (JP) ..... 2004-271654

(51) Int. Cl.
*B65H 5/00* (2006.01)

(52) U.S. Cl. ..... 271/264; 271/265.01

(58) Field of Classification Search ..... 271/264, 271/265.01; 717/162; 318/41–48
See application file for complete search history.

(56) References Cited

U.S. PATENT DOCUMENTS 5,625,262 A * 4/1997 Lapota ..... 318/71
2003/0235450 A1* 12/2003 Okamoto et al. ..... 399/407
2004/0223797 A1* 11/2004 Ueda ..... 399/388
2006/0022401 A1* 2/2006 Akiyama et al. ..... 271/265.01
2008/0232880 A1* 9/2008 Noguchi et al. ..... 399/397

FOREIGN PATENT DOCUMENTS

JP 2001-310842 A 11/2001
JP 2001-322734 A 11/2001
JP 2002-211786 A 7/2002

* cited by examiner

*Primary Examiner*—Patrick H Mackey
*Assistant Examiner*—Gerald W McClain
(74) *Attorney, Agent, or Firm*—Rossi, Kimms & McDowell LLP

(57) ABSTRACT

A motor control apparatus which is capable of controlling driving currents for stepping motors with efficiency. A feedback stepping motor drives sheet feed rollers located most upstream on a sheet conveying path out of a plurality of rollers. A normal stepping motor drives sheet feed rollers located downstream on the sheet conveying path out of the plurality of rollers. A maximum current value required by the feedback stepping motor when a sheet is conveyed is detected. A driving current value for the normal stepping motor is set to a value according to the maximum current value before the sheet enters the downstream sheet feed rollers after passing the upstream sheet feed rollers.

10 Claims, 9 Drawing Sheets

MOTOR CONTROL APPARATUS WITH CONTROLLED INPUT CURRENT

BACKGROUND OF THE INVENTION

1. Field of the Invention

The present invention relates to a motor control apparatus applied to the control of a stepping motor which is used as a driving source for a sheet conveying system of an image forming apparatus, an image forming apparatus provided with the motor control apparatus, a motor control method, and a program for implementing the method.

2. Description of the Related Art

Conventionally, in image forming apparatuses such as a copier, there has been widely used a sheet conveying mechanism in which DC motors or the like are used as driving sources for conveying sheets and driving forces of the DC motors are transmitted to a plurality of conveyor rollers arranged along a sheet conveying path via transmission mechanisms including gears and electromagnetic clutches to thereby convey sheets. In the sheet conveying mechanism, the driving of the conveyor rollers is controlled by opening and closing the electromagnetic clutches to thereby realize sheet conveyance control.

In recent years, with increasing demand for speedup of processing by image forming apparatuses, the speedup of the conveyance of sheets by the sheet conveying mechanism has been increasingly required. However, the conventional sheet conveyance control method of turning on/off the driving of the conveyor rollers by the use of the electromagnetic clutches or the like has a drawback that the response speed of the electromagnetic clutches is slow. This causes a bottleneck in realizing the speedup of the conveyance of sheets.

On the other hand, stepping motors have come to be widely employed as driving sources for a servo system that is small in size and can be controlled in open loop. The stepping motor is constructed such that exciting phase currents for exciting stator windings are sequentially switched to cause rotation of the magnetic field, which causes magnetic poles of a rotor to alternately attract and repel the stator windings to thereby generate torque, whereby the rotor is rotated. Therefore, if the switching of the exciting phases is carried out by inputting a pulse signal, the stepping motor is rotated through a basic angle whenever one pulse is input.

For this reason, open loop control is applicable to the stepping motor. When compared with other servo actuators requiring feedback control, a system including a stepping motor control mechanism can be significantly simplified, which is advantageous in cost.

Therefore, also in the field of image forming apparatuses such as a copier, there have appeared image forming apparatuses which incorporate a stepping motor control mechanism having stepping motors as driving sources, which are driven by a constant-current chopper control system. That is, in the image forming apparatuses of this type, stepping motors as many as the number of conveyor rollers are used as driving sources for the sheet conveying system, to drive the conveyor rollers without using electromagnetic clutches.

However, although the stepping motor can be designed compact in size and at low cost, a phenomenon occurs that the rotation of the rotor of the stepping motor cannot be synchronized with the input of a pulse signal, unlike conventional servo motors. This phenomenon is called "loss of synchronism". In general, the loss of synchronism occurs when the stepping motor is in an overloaded state for the pulse rate of pulses outputted to the stepping motor from a driving circuit.

On the other hand, image forming apparatuses such as a copier are required to handle various types of sheets (plain sheet, thick sheet) and there is a case where torque required of the stepping motor largely varies depending on the type of sheet handled. Taking for example torque required when the sheet enters (a nip formed by) the conveyor rollers made of sponge and arranged along the sheet conveying path of the image forming apparatus, the torque required for the thick sheet (200 g/cm) can become 2 to 3 times as large as the torque required for the plain sheet (80 g/cm). Therefore, the selection of a stepping motor and the selection of the driving current for the stepping motor that determines output torque are carried out so as to cope with the thick sheet that usually requires such severe conditions.

Under the above described situations, to optimally control the stepping motor while avoiding loss of synchronism, for example, there has been proposed a technology in which, when thick sheets are conveyed, the distance between sheets is made larger than that in the case of conveying plain sheets to reduce torque applied to the stepping motor to thereby prevent loss of synchronism (for example, refer to Japanese Laid-Open Patent Publication (Kokai) No. 2001-310842).

Moreover, there has been proposed a technology in which, when thick sheets are conveyed, the driving current for the stepping motor is set to such a value as to output torque large enough to feed and convey the thick sheets to thereby prevent loss of synchronism (for example, refer to Japanese Laid-Open Patent Publication (Kokai) No. 2001-322734).

Furthermore, there has been proposed a technology in which thick sheets are conveyed at a rotational speed of the stepping motor slower than a rotational speed thereof for conveying plain sheets to reduce torque applied to the stepping motor and hence prevent loss of synchronism (for example, refer to Japanese Laid-Open Patent Publication (Kokai) No. 2002-211786).

On the other hand, in recent years, a feedback stepping motor has been developed as a new type stepping motor. The feedback stepping motor has provided therein a sensor for sensing a rotor position and monitors information on the rotational speed and the amount of rotation via the sensor during rotation as is the case with a servo motor, and when loss of synchronism is about to occur, immediately performs closed loop control, to thereby prevent occurrence of loss of synchronism even when the feedback stepping motor undergoes rapid load fluctuations or rapid acceleration.

However, the above conventional stepping motor control mechanism for image forming apparatuses has the following problems and hence there is demand for improvement to solve the problems.

As a typical method of using a stepping motor, it can be envisaged that when high torque is required only for a moment, the driving current setting of the stepping motor is variably controlled only for the moment. In general, the sheet conveying system of an image forming apparatus requires many (a dozen or so) stepping motors for driving many (a dozen or so) conveyor rollers and sheet feed rollers and hence it is necessary to control the set current value for each of the stepping motors in timing corresponding to each peak of the substantial torque on motor by motor basis and sheet by sheet basis, which results in complicated control of the stepping motors. Therefore, under the present circumstances, the driving current of each stepping motor has to be set in advance so as to cope with torque required under severe conditions.

As a result of such setting of the driving current, while the optimum torque can be outputted during the conveyance sequence of thick sheets, excessive torque that is larger than the required torque is outputted during the conveyance sequence of plain sheets. This causes a problem that the motors produce large vibration components, resulting adverse effects of noise. Moreover, currents larger than required amounts of current flow to the stepping motors during the conveyance sequence of plain sheets, resulting in the temperature rising high. Furthermore, the currents of the stepping motors are set in view of the case where the conveyance conditions are severe (stepping motors having a large current set range need to be used), which results in degraded efficiency and hence increased cost of the apparatus.

Moreover, the above-described technologies disclosed in Japanese Laid-Open Patent Publications (Kokai) Nos. 2001-310842 and 2002-211786 in which the distance between the sheets is made larger and the rotational speed is made slower, have a drawback that the number of sheets that can be subjected to image formation is reduced, thus leading to degraded productivity. Furthermore, the above-described technology disclosed in Japanese Laid-Open Patent Publication (Kokai) No. 2001-322734 has a drawback that when sheets of irregular types, that is, sheets other than the thick sheet and the plain sheet are conveyed, loss of synchronism cannot be prevented.

In addition, if the above-described feedback stepping motor can be used as a driving source for the sheet conveying system, no control is required for driving current setting, thus effectively preventing loss of synchronism. However, currently the feedback stepping motor is very expensive, so that it is not practical to employ such feedback stepping motors as many as the many (a dozen or so) conveyor rollers and sheet feed rollers constituting the sheet conveying system as the driving sources.

SUMMARY OF THE INVENTION

It is an object of the present invention to provide a motor control apparatus, an image forming apparatus, and a motor control method, which are capable of controlling the driving currents for stepping motors with efficiency, and a program for implementing the method.

To attain the above object, in a first aspect of the present invention, there is provided a motor control apparatus that controls a first motor for driving first rollers located at an upstream location on a sheet conveying path and feeding a sheet while nipping the sheet therebetween, and a second motor for driving second rollers located at a downstream location on the sheet conveying path and feeding the sheet while nipping the sheet therebetween, the motor control apparatus comprising a first driving device that drives the first motor, a second driving device that drives the second motor, and a control device that detects a maximum current value required by the first motor when the sheet is conveyed and sets a driving current value for the second motor to a value according to the maximum current value before the sheet enters the second rollers after passing the first rollers.

Preferably, the control device switches the driving current value for the second motor from the value according to the maximum current value to a value according to a normal current value at a predetermined time point after setting the driving current value for the second motor to the value according to the maximum current value.

More preferably, the motor control apparatus further comprises a sheet detecting device that is disposed between the first rollers and the second rollers, for detecting presence or absence of a sheet, and the control device switches the driving current value for the second motor from a value according to a normal current value to the value according to the maximum current value upon lapse of a predetermined time interval after the sheet detecting device detects the present or absence of the sheet, and switches the driving current value for the second motor from the value according to the maximum current value to the value according to the normal current value when the sheet detecting device detects the absence of the sheet while the sheet is nipped between the second rollers.

Preferably, the first motor is a feedback stepping motor and the second motor is a normal stepping motor.

Still more preferably, the motor control apparatus further comprises a time counting device that counts time, and the predetermined time interval is a predetermined time period counted by the time counting device after the sheet detecting device detects the presence of the sheet.

Also preferably, the motor control apparatus further comprising a pulse counting device that counts a number of pulses outputted to the first motor, and the predetermined time interval is a time interval after the sheet detecting device detects the presence of the sheet and until a predetermined number of pulses outputted to the first motor are counted by the pulse counting device.

Preferably, the motor control apparatus further comprises a current detecting device that detects a current flowing to the first motor when the sheet enters the first rollers, and the value according to the maximum current value is a current value detected by the current detecting device.

To attain the above object, in a second aspect of the present invention, there is provided a motor control apparatus that controls a first motor for driving first rollers located at an upstream location on a sheet conveying path and feeding a sheet while nipping the sheet therebetween, and a second motor for driving second rollers located at a downstream location on the sheet conveying path and feeding the sheet while nipping the sheet therebetween, the motor control apparatus comprising a first driving device that drives the first motor, a second driving device that drives the second motor, and a control device that detects a maximum current value required by the first motor when the sheet is conveyed and temporarily sets a driving current value for the second motor to a value according to the maximum current value before the sheet enters the second rollers after passing the first rollers, and switches the driving current value for the second motor from the value according to the maximum current value to a value according to a normal current value at a predetermined time point after setting the driving current value for the second motor to the value according to the maximum current value.

To attain the above object, in a third aspect of the present invention, there is provided an image forming apparatus comprising an image forming unit that forms an image on a sheet, a sheet conveying path, first rollers that are located at an upstream location on the sheet conveying path and feed the sheet while nipping the sheet therebetween, second rollers that are located at a downstream location on the sheet conveying path and feed the sheet while nipping the sheet therebetween, a first motor for driving the first rollers, a second motor for driving the second rollers, and a motor control apparatus comprising a first driving device that drives the first motor, a second driving device that drives the second motor, and a control device that detects a maximum current value required by the first motor when the sheet is conveyed and sets a driving current value for the second motor to a value according to the maximum current value before the sheet enters the second rollers after passing the first rollers.

Preferably, the control device switches the driving current value for the second motor from the value according to the maximum current value to a value according to a normal current value at a predetermined time point after setting the driving current value for the second motor to the value according to the maximum current value.

To attain the above object, in a fourth aspect of the present invention, there is provided a motor control method of controlling a first motor for driving first rollers located at an upstream location on a sheet conveying path and feeding a sheet while nipping the sheet therebetween, and a second motor for driving second rollers located at a downstream location on the sheet conveying path and feeding the sheet while nipping the sheet therebetween, the motor control method comprising a detecting step of detecting a maximum current value required by the first motor when the sheet is conveyed, and a control step of setting a driving current value for the second motor to a value according to the maximum current value before the sheet enters the second rollers after passing the first rollers.

To attain the above object, in a fifth aspect of the present invention, there is provided a motor control method of controlling a first motor for driving first rollers located at an upstream location on a sheet conveying path and feeding a sheet while nipping the sheet therebetween, and a second motor for driving second rollers located at a downstream location on the sheet conveying path and feeding the sheet while nipping the sheet therebetween, the motor control method comprising a detecting step of detecting a maximum current value required by the first motor when the sheet is conveyed, a setting step of temporarily setting a driving current value for the second motor to a value according to the maximum current value before the sheet enters the second rollers after passing the first rollers, and a switching step of switching the driving current value for the second motor from the value according to the maximum current value to a value according to a normal current value at a predetermined time point after setting the driving current value for the second motor to the value according to the maximum current value.

To attain the above object, in a sixth aspect of the present invention, there is provided a program for causing a computer to implement a motor control method of controlling a first motor for driving first rollers located at an upstream location on a sheet conveying path and feeding a sheet while nipping the sheet therebetween, and a second motor for driving second rollers located at a downstream location on the sheet conveying path and feeding the sheet while nipping the sheet therebetween, the program comprising a detecting module for detecting a maximum current value required by the first motor when the sheet is conveyed, and a control module for setting a driving current value for the second motor to a value according to the maximum current value before the sheet enters the second rollers after passing the first rollers.

To attain the above object, in a seventh aspect of the present invention, there is provided a program for causing a computer to implement a motor control method of controlling a first motor for driving first rollers located at an upstream location on a sheet conveying path and feeding a sheet while nipping the sheet therebetween, and a second motor for driving second rollers located at a downstream location on the sheet conveying path and feeding the sheet while nipping the sheet therebetween, the program comprising a detecting module for detecting a maximum current value required by the first motor when the sheet is conveyed a setting module for temporarily setting a driving current value for the second motor to a value according to the maximum current value before the sheet enters the second rollers after passing the first rollers, and a switching module for switching the driving current value for the second motor from the value according to the maximum current value to a value according to a normal current value at a predetermined time point after setting the driving current value for the second motor to the value according to the maximum current value.

According to the present invention, a first motor that drives first rollers and a second motor that drives second motors are driven, a maximum current value required by the first motor when the sheet is conveyed is detected, and the driving current value for the second motor is set to a value according to the maximum current value before the sheet enters the second rollers after passing the first rollers. As a result, it is possible to set an optimum current value without setting the maximum current value for each type of sheet as in the prior art, so as to prevent the stepping motor used as the second motor from getting out of synchronism. Moreover, since the current value can be set in the optimal timing in which torque is applied to the stepping motor, it is possible to control the value of current flowing to the stepping motor with high efficiency.

Further, even when an irregular type of sheet is fed in the image forming apparatus, it is not necessary to set the driving current for the stepping motor.

Still further, according to the present invention, normal stepping motors can be used as all the motors except for the feedback stepping motor used as the first motor for driving the first rollers located upstream out of the plurality of rollers. As a result, it is possible to realize an inexpensive construction.

The above and other objects, features, and advantages of the invention will become more apparent from the following detailed description taken in conjunction with the accompanying drawings.

DETAILED DESCRIPTION OF THE PREFERRED EMBODIMENT

The present invention will now be described in detail with reference to the drawings showing a preferred embodiment thereof.

Figure 1:
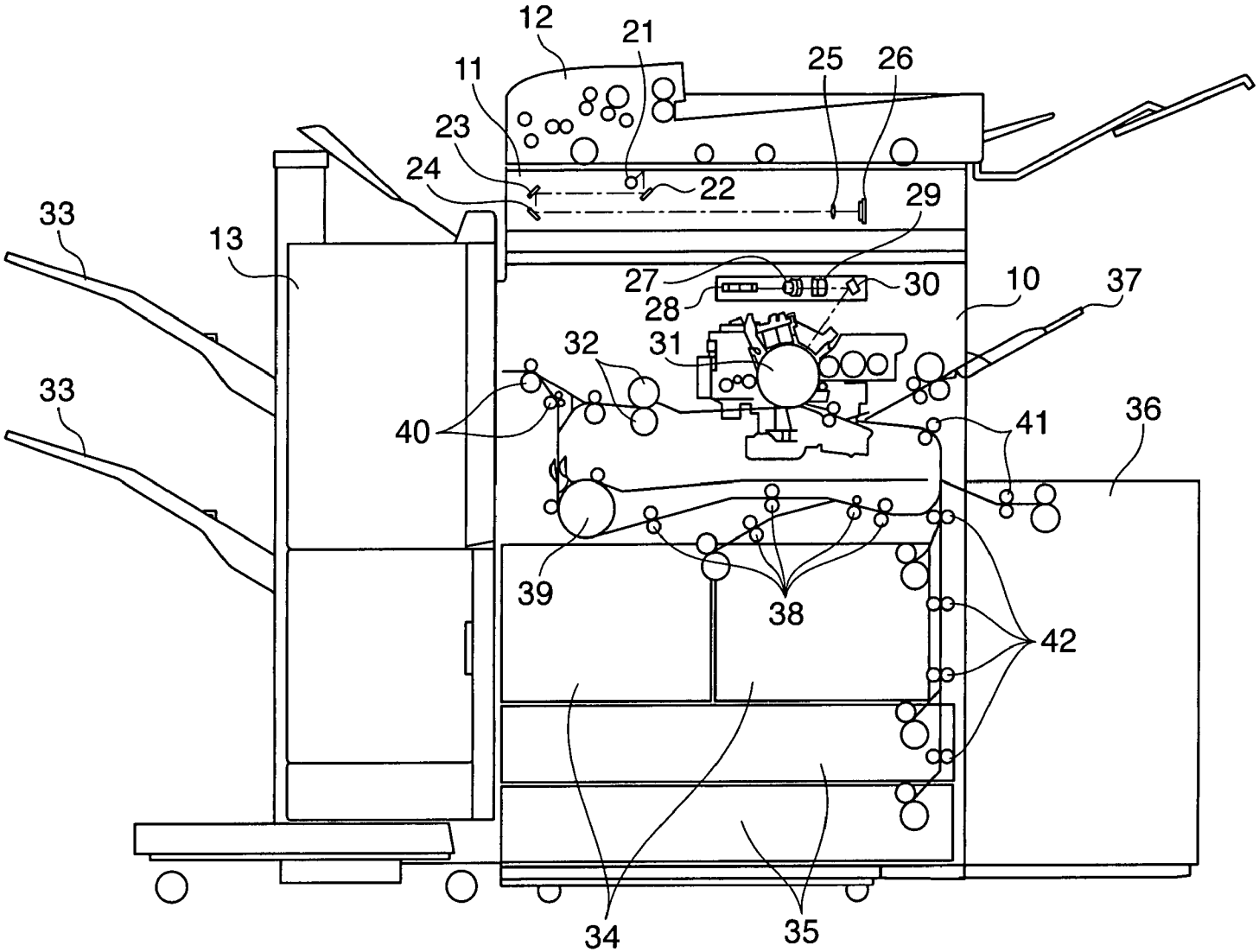
FIG. 1 is a view schematically showing the construction of an image forming apparatus provided with a motor control apparatus according to an embodiment of the present invention.

FIG. 1 is a view schematically showing the construction of an image forming apparatus provided with a motor control apparatus according to an embodiment of the present invention.

As shown in FIG. 1, the image forming apparatus is implemented by a digital copier, for example, and is mainly comprised of a printer unit 10, a reader unit 11, an automatic document feeder 12, and a sorter 13.

The automatic document feeder 12 automatically feeds an original to be copied to a reading position on an original platen glass. The reader unit 11 reads an image from the original. The printer unit 10 copies the image read from the original to a sheet and outputs the copied image. The sorter 13 sorts sheets to which images have been copied and which are to be ejected from the printer unit 10.

First, the reader unit 11 will be described. Light emitted from a light source 21, which is reciprocated in left and right directions as viewed in FIG. 1 by a driving force of an optical system motor (not shown), is reflected by the original placed on the original platen glass. The reflected light from the original forms an image on a CCD 26 via mirrors 22 to 24 that are driven together with the light source 21, and a lens 25. The reflected light from the original is converted into an electronic signal by a photoelectric conversion device constituting the CCD 26 and then is further converted into a digital signal (image data). The image data is subjected to various kinds of correction processing and image processing and then is stored in an image memory (not shown).

Next, the printer unit 10 will be described. The image data stored in the image memory is read and reconverted from the digital signal into an analog signal and then is amplified to an appropriate output level by an exposure control section (not shown) and then is converted into an optical signal by an optical irradiation section 27. The optical signal is transmitted through a scanner 28, a lens 29, and a mirror 30 and is irradiated onto a photosensitive drum 31 to form an electrostatic latent image thereon. An image is formed from the latent image using toner, and the toner image is transferred onto a sheet conveyed in the printer unit 10 and is further fixed onto the sheet by fixing rollers 32. In this way, the image is copied to the sheet, and the sheet with the image thus formed thereon is conveyed to the sorter 13.

On the other hand, sheets stored in a sheet feed tray 34, a sheet feed tray 35, or a sheet feed deck 36 are conveyed as appropriate to a transfer position near the photosensitive drum 31 and image formation is carried out on the sheets under the control of a main body control unit (not shown). A manual feed tray 37 is used for manually feeding plain sheets but also for manually feeding special sheets such as OHP sheet, thick sheet, or postcard sized sheet. Sheet feed rollers 38 to 42 play the role of feeding or conveying sheets for image copy processing and are connected to stepping motors (described later) as driving sources via a transmission mechanism formed of gears and others, independently of each other.

Here, the rotational speeds of the photosensitive drum 31 and the fixing rollers 32, which are rotatively driven by DC brushless motors, are called a process speed and depend, to a large degree, upon the shapes and fixing characteristics of toner particles, light emitting characteristics of laser used as the optical signal, etc. Thus, the rotational speeds of the photosensitive drum 31 and the fixing rollers 32 are controlled to speed values specific to each image forming apparatus. The frequency at which the photosensitive drum 31 and the fixing rollers 32 are driven at a constant speed for a long time is high. Therefore, motors such as the above-mentioned DC brushless motor capable of producing torque large enough to convey thick sheets are selected as the driving sources for the photosensitive drum 31 and the fixing rollers 32.

In contrast to this, the sheet feed rollers 38 to 42 perform only the operation of feeding or conveying sheets. Therefore, when a sheet is not nipped by either of the photosensitive drum 31 and the fixing rollers 32, the sheet feed rollers 38 to 42 are driven at speeds as high as possible to feed or convey sheets at a high speed and are controlled so as to make the distance between the sheets to the minimum possible distance. With this driving and control, the productivity of the image forming apparatus can be enhanced.

Next, the sorter 13 will be described. When sheets already subjected to the above-described image copy processing are fed to the sorter 13 from the printer unit 10, the sheets are sorted into arbitrarily selected ones of a plurality of sheet discharge trays 33 provided in the sorter 13 that are designated by the main control unit (not shown).

Next, a description will be given of the construction of a feedback stepping motor, which is used as a driving source for a predetermined sheet feed roller of the plurality of sheet feed rollers 38 to 42 provided in the image forming apparatus. The feedback stepping motor has provided therein a rotor position sensor for sensing a rotor position. As is the case with the servo motor, information on the rotational speed and the amount of rotation of the feedback stepping motor is monitored by the rotor position sensor during rotation of the feedback stepping motor, and immediately when the feedback stepping motor is about to get out of synchronism, the feedback stepping motor is controlled in closed mode.

Figure 2:
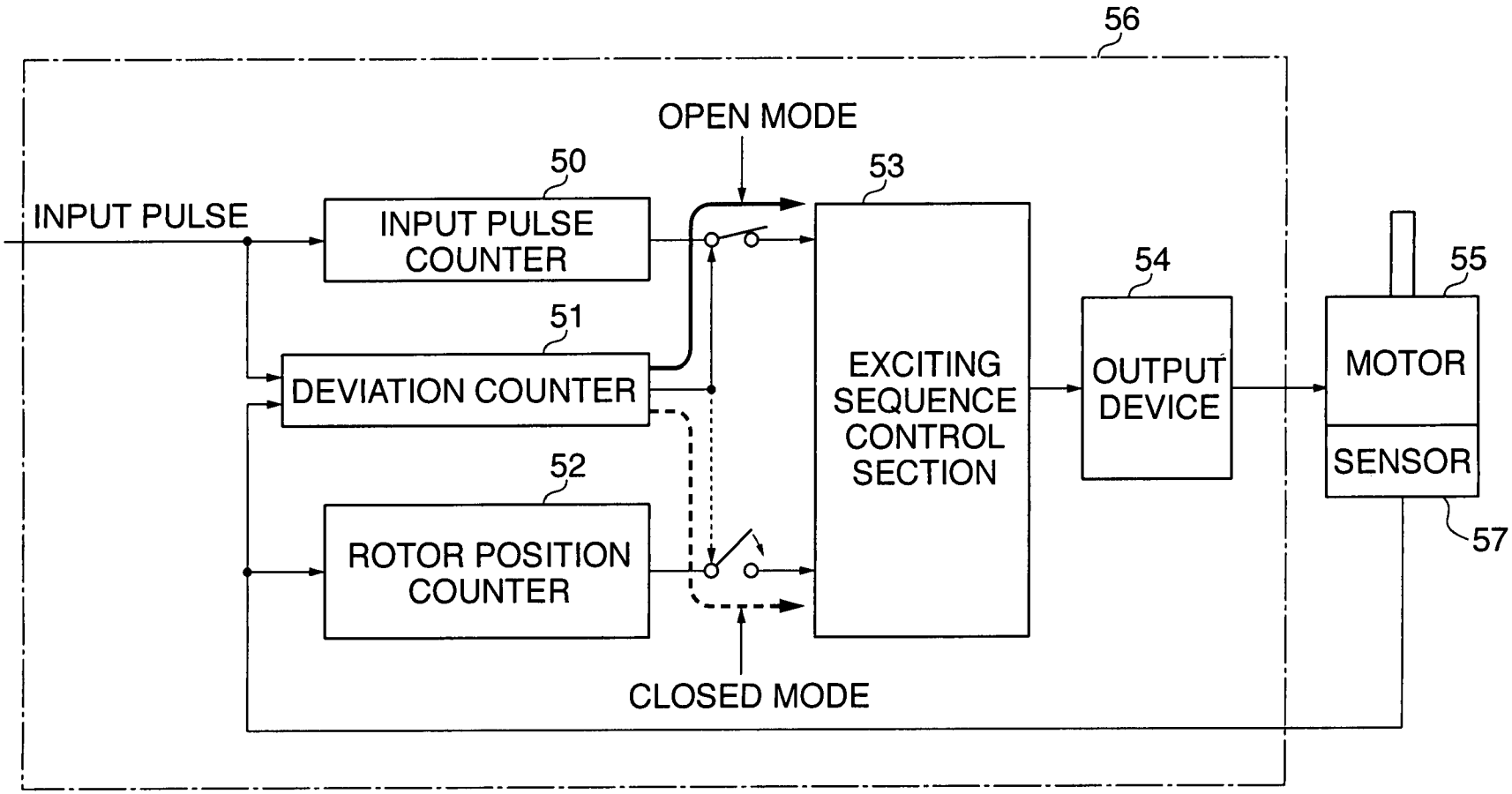
FIG. 2 is a block diagram showing the configuration of a control system for a feedback stepping motor mounted in the image forming apparatus in FIG. 1.

FIG. 2 is a block diagram showing the configuration of a control system for the feedback stepping motor mounted in the image forming apparatus.

Figure 5:
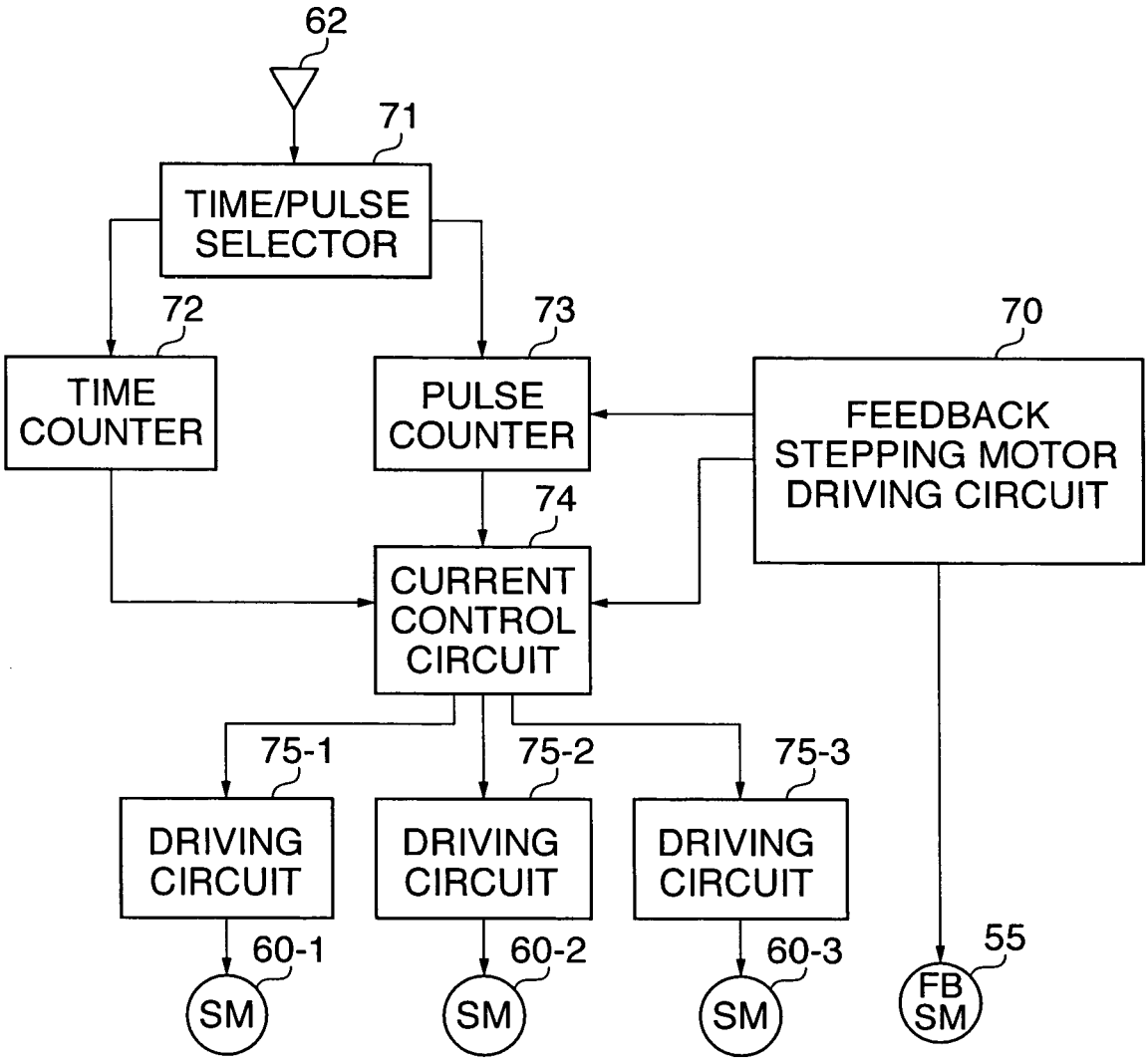
FIG. 5 is a block diagram showing the configuration of the control system for the feedback stepping motor and the normal stepping motor.

As shown in FIG. 2, a feedback drive control unit 56 controls the driving of the feedback stepping motor 55 and is comprised of an input pulse counter 50, a deviation counter 51, a rotor position counter 52, an exciting sequence control section 53, and an output device 54. The feedback drive control unit 56 and a pulse generating unit (not shown) constitute a feedback stepping motor driving circuit 70 which is shown in FIG. 5, described later. The feedback stepping motor 55 has the rotor position sensor 57 provided therein and outputs encoder pulses to the deviation counter 51 and the rotor position counter 52.

The input pulse counter 50 counts input pulses inputted to the feedback drive control unit 56 from the pulse generating unit (not shown). The deviation counter 51 counts a position deviation between the input pulses and the encoder pulses outputted from the feedback stepping motor 55. The rotor position counter 52 counts the encoder pulses outputted from the stepping motor 55. The exciting sequence control section 53 controls an exciting sequence for the feedback stepping motor 55 based upon a counter value outputted from the input pulse counter 50 or a counter value outputted from the rotor position counter 52. The output device 54 outputs a control signal from the exciting sequence control section 53 to the feedback stepping motor 55.

The position deviation between the input pulses and the encoder pulses outputted from the feedback stepping motor 55 is measured by the deviation counter 51. When the position deviation is smaller than ±1.8 degrees, for example, the feedback stepping motor 55 is controlled in open mode, as indicated by the solid line with an arrow in FIG. 2, whereas, when the position deviation is not smaller than ±1.8 degrees, for example, the control mode is switched from the open mode to closed mode whereby a driving current is changed to control the feedback stepping motor 55, as indicated by the broken line with an arrow in FIG. 2, to thereby prevent the feedback stepping motor 55 from getting out of synchronism.

Figure 3:
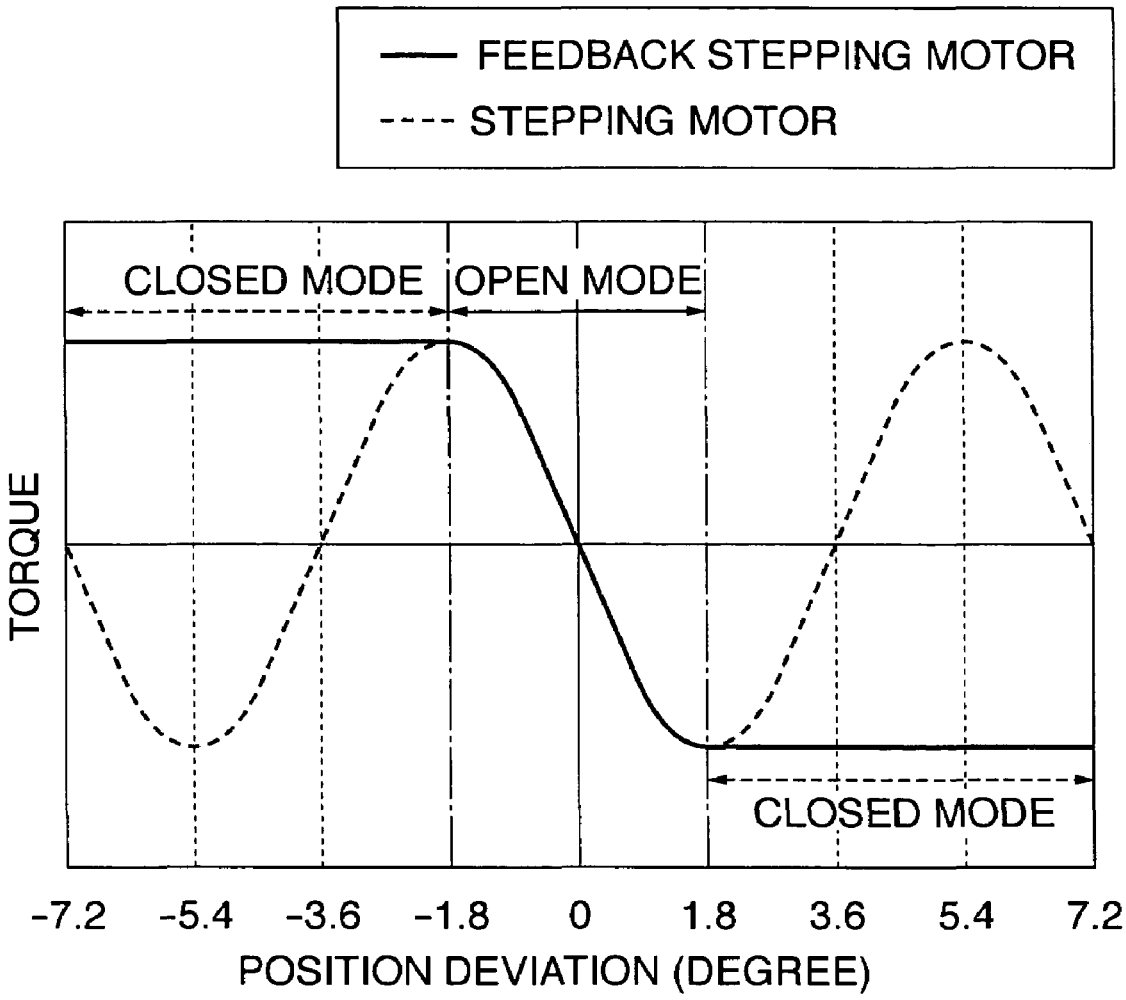
FIG. 3 is a graph showing position deviation vs. torque characteristics of the feedback stepping motor in FIG. 2 and a normal stepping motor.

FIG. 3 is a graph showing position deviation vs. torque (θ–T) characteristics of the feedback stepping motor and a normal stepping motor.

In FIG. 3, the abscissa denotes the position deviation (degrees) and the ordinate denotes torque. The thick solid line indicates a characteristic of the feedback stepping motor and the thin broken line shows a characteristic of the stepping motor. As described above with reference to FIG. 2, when the position deviation is smaller than ±1.8 degrees during control of the feedback stepping motor, the feedback stepping motor is controlled in open mode as is the case with a normal stepping motor, whereas, when the position deviation is not smaller than ±1.8 degrees, the feedback stepping motor is controlled in closed mode, whereby the stator windings are excited with a current phase difference that generates the maximum torque with respect to the rotor position of the feedback stepping motor.

Figure 4:
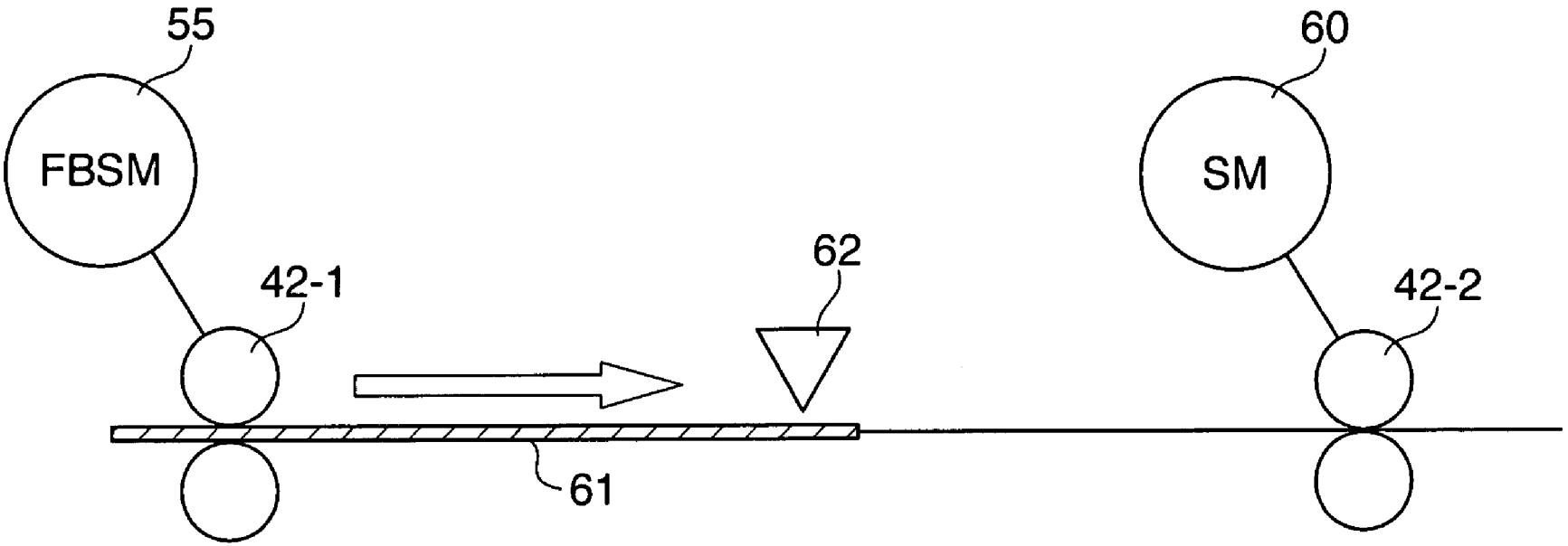
FIG. 4 is a view schematically showing the arrangement of a sheet conveying path, the feedback stepping motor, the normal stepping motor, and sheet feed rollers of the image forming apparatus in FIG. 1.

FIG. 4 is a view schematically showing the arrangement of a sheet conveying path, the feedback stepping motor, the normal stepping motor, and the sheet feed rollers of the image forming apparatus in FIG. 1.

As shown in FIG. 4, sheet feed rollers 42-1, sheet feed rollers 42-2, and a sensor 62 for sensing the presence or absence of a sheet (hereinafter simply referred to as the "the sensor 62") are arranged along a sheet conveying path. A sheet 61 is conveyed in a direction indicated by the arrow in FIG. 4. The pair of sheet feed rollers 42-1, which are located at the most upstream location out of the plurality of sheet feed rollers 42 shown in FIG. 1, feed a sheet while nipping the sheet therebetween and are rotatively driven by the feedback stepping motor 55. The pair of sheet feed rollers 42-2, which are located at the most downstream location out of the plurality of sheet feed rollers 42 shown in FIG. 1, feed a sheet while nipping the sheet therebetween and are rotatively driven by the normal stepping motor 60. The sensor 62 is disposed at a location intermediate between the sheet feed rollers 42-1 and the sheet feed rollers 42-2 and detects the presence or absence of a sheet.

Here, the positional relationship (interval) between the sheet feed rollers 42-2 and the sensor 62 is set such that at the moment when the trailing end of the sheet passes the sensor 62, the sheet has already started to be nipped between the sheet feed rollers 42-2 and then the sensor 62 detects that the sheet is absent.

FIG. 5 is a block diagram showing the configuration of the control system for the feedback stepping motor and the normal stepping motor. In the example of FIG. 5, three stepping motors 60-1 to 60-3 are provided as the normal stepping motor 60.

As shown in FIG. 5, a feedback stepping motor driving circuit 70 drives the feedback stepping motor 55 and incorporates therein the feedback drive control unit 56 shown in FIG. 2 and the pulse generating unit (not shown).

A time counter 72 counts a time period that elapses after the sensor 62 detects that the sheet is present on the sheet conveying path, for the first time. A pulse counter 73 counts the number of counts outputted to the feedback stepping motor 55 from the feedback stepping motor driving circuit 70 after the sensor 62 detects that the sheet is present on the sheet conveying path, for the first time. Outputs from the time counter 72 and the pulse counter 73 are used as timing signals for setting currents applied to the stepping motors 60-1 to 60-3 to a second current value which will be described later.

A time/pulse selector 71 determines which of the outputs from the time counter 72 and the pulse counter 73 is to be selected, based upon setting inputted via an operating section (not shown) of the image forming apparatus.

A stepping motor current control circuit 74 sets the maximum current value that can be applied to the feedback stepping motor 55 during conveyance of a sheet as the second current value for the stepping motors 60-1 to 60-3. The stepping motor current control circuit 74 outputs the second current value and a set timing value to driving circuits 75-1 to 75-3 in response to the timing signal being inputted from the time counter 72 or the pulse counter 73. The driving circuits 75-1 to 75-3 drive the stepping motors 60-1 to 60-3, respectively. The stepping motors 60-1 to 60-3 rotatively drive respectively the sheet feed rollers located downstream of the sheet feed rollers 42-1 located at the most upstream location out of the plurality of sheet feed rollers 42 shown in FIG. 1.

Here, normal current values that are applied to the feedback stepping motor 55 and the stepping motors 60-1 to 60-3 are set as a first current value, where the above-mentioned second current value is larger than the first current value. The normal current values for the respective motors may be different from each other. Therefore, the current values for the respective stepping motors 60-1 to 60-3 determined based upon the maximum current value for the feedback stepping motor 55 may be also different from each other.

In the following description, the stepping motors 60-1 to 60-3 will be collectively referred to as the stepping motor 60 and the driving circuits 75-1 to 75-3 as the driving circuit 75.

When the sheet 61 enters the sheet feed rollers 42-1 during the sheet feeding operation of the image forming apparatus, a current flowing to the feedback stepping motor 55 is monitored by the stepping motor current control circuit 74, and the maximum current value I1 for the feedback stepping motor 55 is set as the second current value by the stepping motor current control circuit 74. It should be noted that the second current value does not need to be the same value as the maximum current value I1 for the feedback stepping motor 55 and may be a value set according to the maximum current value I1.

Figure 6:
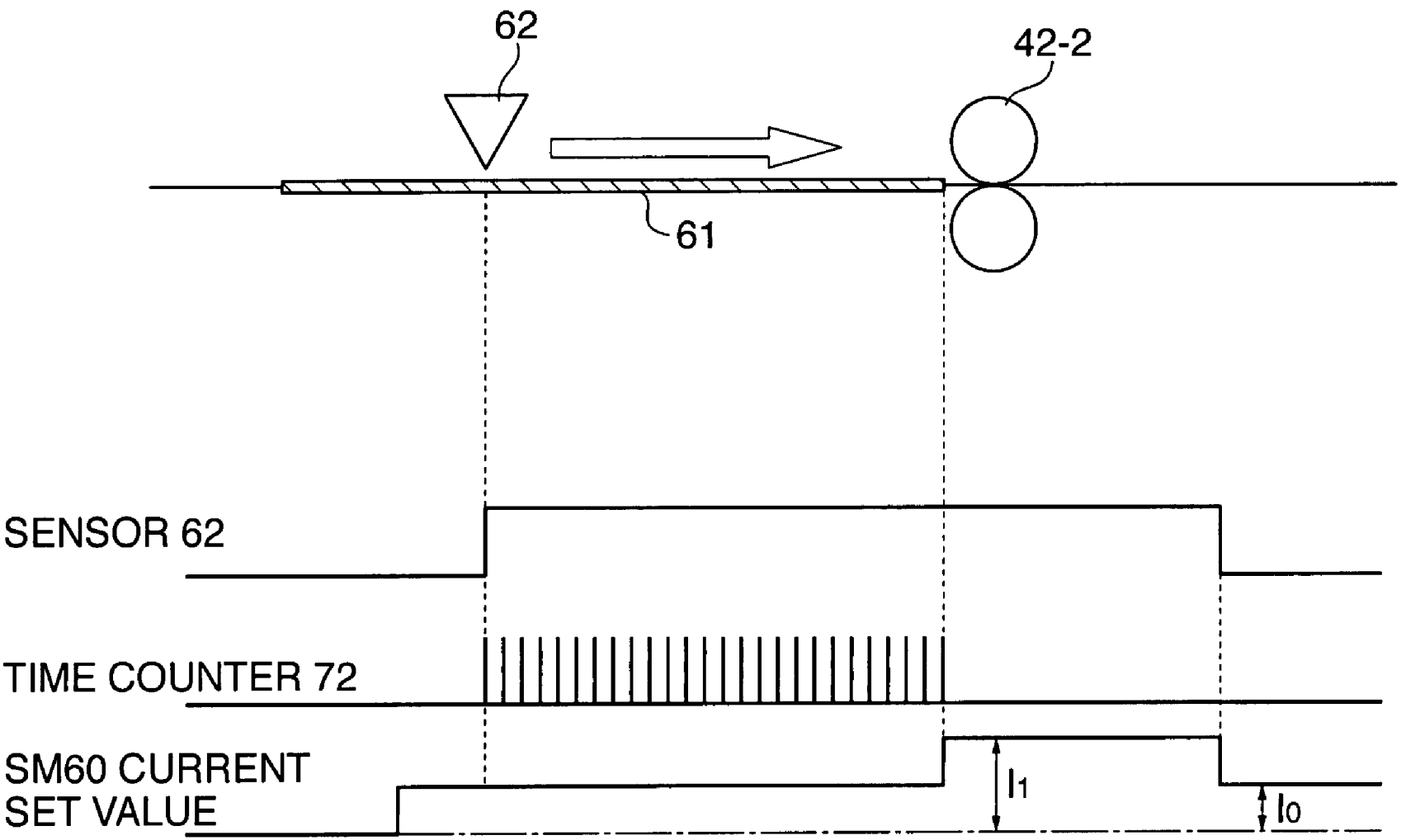
FIG. 6 is a timing chart relating to the setting of a current value for the normal stepping motor.
Figure 7:
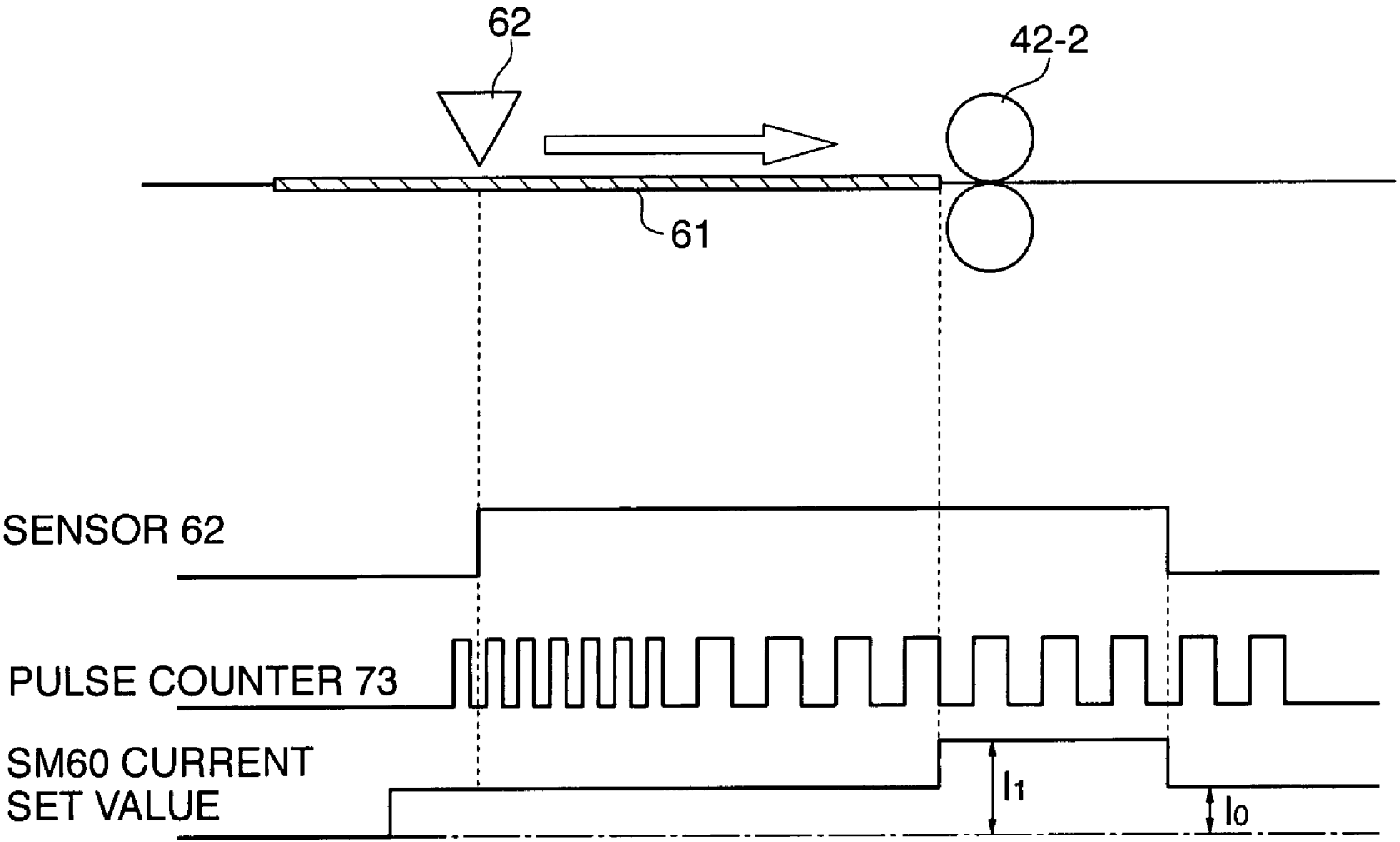
FIG. 7 is a timing chart relating to the setting of current of the normal stepping motor.

FIG. 6 is a timing chart in the case where the driving current for the stepping motor 60 is set when a predetermined time period has elapsed after the sensor 62 detected the presence of a sheet for the first time. FIG. 7 is a timing chart in the case where the driving current for the stepping motor 60 is set when a predetermined number of pulses have been outputted to the feedback stepping motor 55 after the sensor 62 detected the presence of a sheet for the first time.

In both FIG. 6 and FIG. 7, the driving current for the stepping motor 60 is returned to a normal current value I0 from the maximum current value I1 in a state immediately after the trailing end of a sheet 61 has passed the sensor 62, that is, when In the case where the driving current for the stepping motor 60 is set when the predetermined time period has elapsed after the sensor 62 detects the presence of the sheet for the first time, as in the example of FIG. 6, it is desired that the sheet feeding speed is always constant.

Moreover, there can be a case where the sheet feed speed varies (FIG. 7) or the sheet stops before the sheet reaches the sheet feed rollers 42-2 after passing the sensor 62. In view of such a case, it is preferable to set the driving current for the stepping motor 60 after a predetermined number of pulses are outputted to the feedback stepping motor 55.

The above two current setting methods for the stepping motor 60 can be selected and set via the operating section of the image forming apparatus.

In the present embodiment, the feedback stepping motor 55 is used as a driving source for the most upstream sheet feed rollers 42-1 in consideration of the fact that it is when the sheet enters the sheet feed rollers that the stepping motor is most likely to get out of synchronism during the conveyance of the sheet in the image forming apparatus. That is, the maximum current value for the feedback stepping motor 55 is detected when the sheet enters the sheet feed rollers 42-2, and then the driving current for the stepping motor 60 as the driving source of the downstream sheet feed rollers is set. This control makes it possible to prevent the stepping motor 60 from getting out of synchronism upon occurrence of load fluctuations caused when the sheet enters the sheet feed rollers without employing feedback stepping motors for all the motors and realize current control with high efficiency.

Next, the above two current setting methods for the stepping motor 60 will be described with reference to FIGS. 8 and 9.

Figure 8:
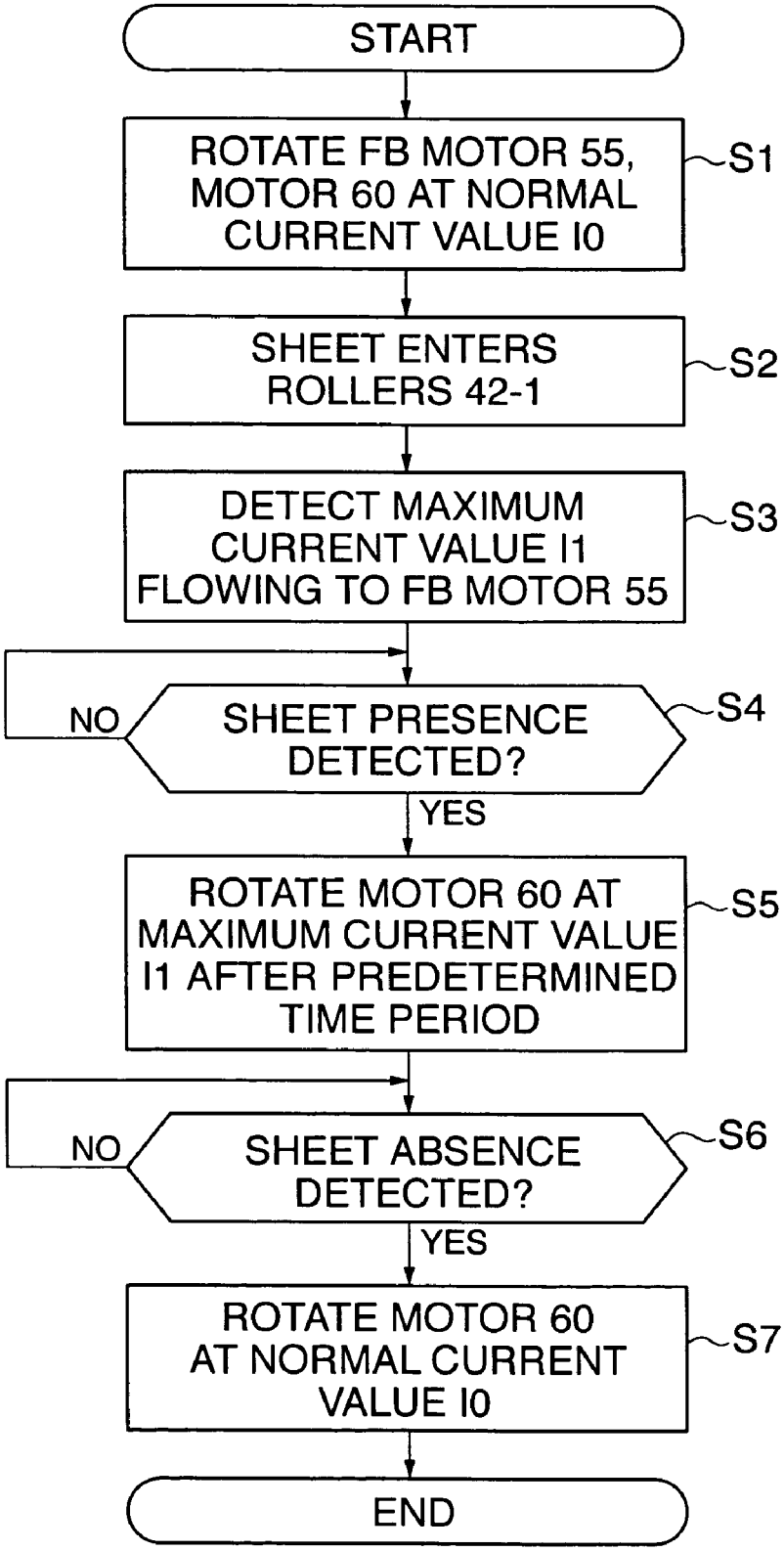
FIG. 8 is a flow chart showing the processing of setting the current value for the stepping motor.

FIG. 8 is a flow chart showing a process for setting the driving current for the stepping motor 60 when the predetermined time period has elapsed after the sensor 62 detects the presence of a sheet for the first time. The present process is executed by the stepping motor current control circuit 74 shown in FIG. 5.

As shown in FIG. 8, after the start of conveying the sheet, the feedback stepping motor driving circuit 70 is caused to rotatively drive the feedback stepping motor 55 at the normal current value I0 (first current value) and the driving circuit 75 is caused to rotatively drive the stepping motor 60 at a normal current value I0 (first current value) (step S1). It should be noted that the driving current value for starting to drive the stepping motor 60 may be different from the driving current value for starting to drive the feedback stepping motor 55. Next, when the sheet enters the sheet feed rollers 42-1 (step S2), the maximum current value I1 of current flowing to the feedback stepping motor 55 is detected by the stepping current control circuit 74 (step S3). When the sheet passes the sheet feed rollers 42-1 and the sensor 62 detects the presence of the sheet (step S4), the time counter 72 counts a time period that elapses after the sensor 62 detects the presence of the sheet.

After the predetermined time period has elapsed, that is, just before the sheet enters the sheet feed rollers 42-2, the driving circuit 75 is caused to switch the driving current for the stepping motor 60 from the above normal current value I0 to the maximum current value I1 (second current value) to rotatively drive the stepping motor 60 (step S5). With this, the stepping motor 60 has its torque increased to a value required when the sheet enters the sheet feed rollers 42-2. Then, when the sensor 62 detects the absence of the sheet with the sheet 61 nipped between the sheet feed rollers 42-2 (step S6), the driving circuit 75 is caused to switch the driving current for the stepping motor 60 from the maximum current value I1 to the normal current value I0 to rotatively drive the stepping motor 60 (step S7).

Figure 9:
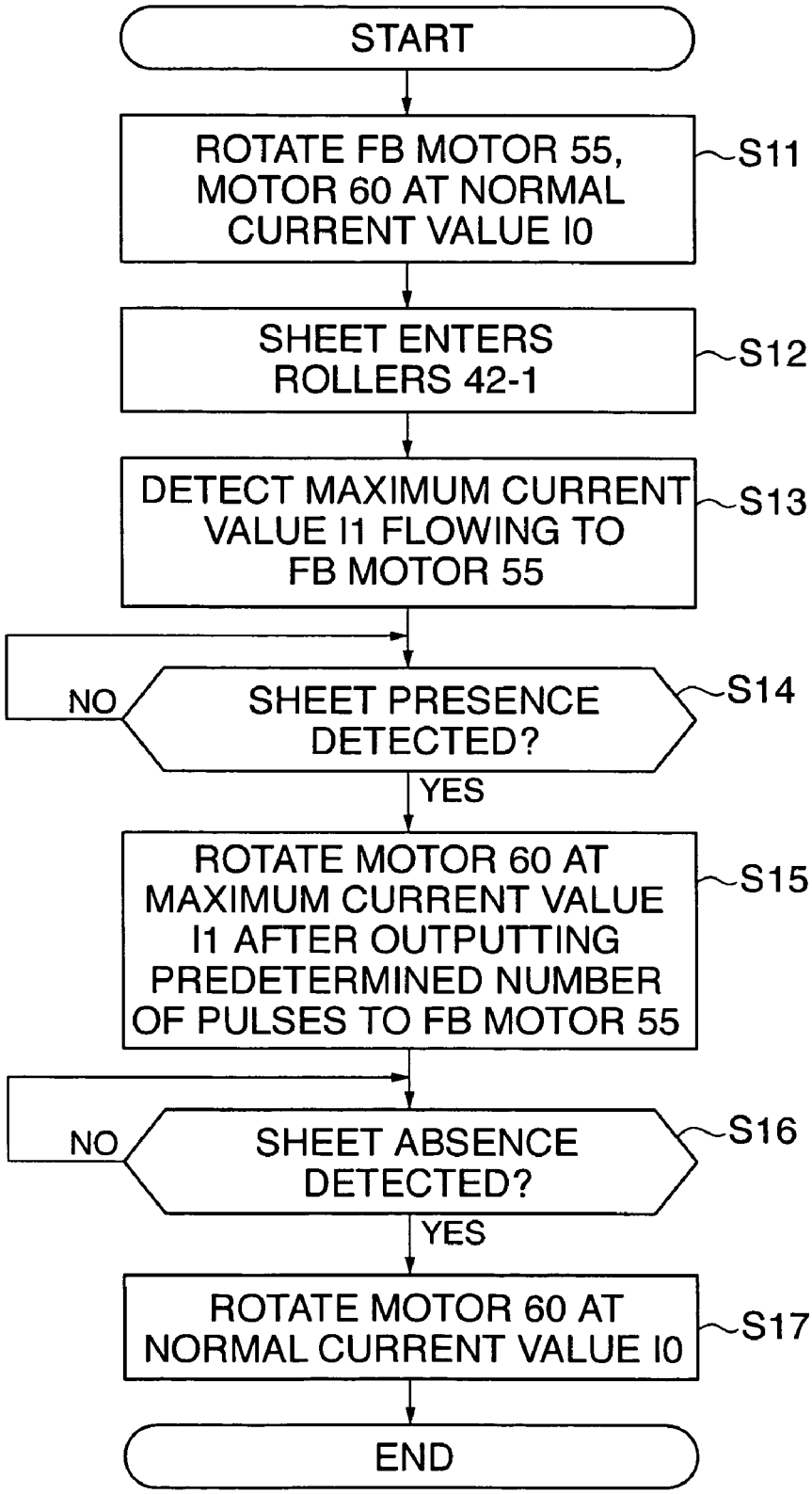
FIG. 9 is a flow chart showing the processing of setting the current value for the normal stepping motor.

FIG. 9 is a flow chart showing a process for setting the driving current for the stepping motor 60 when the predetermined number of pulses have been outputted to the feedback stepping motor 55 after the sensor 62 detects the presence of a sheet. The present process is executed by the stepping motor current control circuit 74 shown in FIG. 5.

As shown in FIG. 9, after the start of conveying the sheet, the feedback stepping motor driving circuit 70 is caused to rotatively drive the feedback stepping motor 55 at the normal current value I0 (first current value) and the driving circuit 75 is caused to rotatively drive the stepping motor 60 at the normal current value I0 (first current value) (step S11). It should be noted that the current for starting to drive the stepping motor 60 may be different from the current for starting to drive the feedback stepping motor 55. Next, when the sheet enters the sheet feed rollers 42-1 (step S12), the maximum current value I1 of current flowing to the feedback stepping motor 55 is detected by the stepping current control circuit 74 (step S13). When the sheet passes the sheet feed rollers 42-1 and then the sensor 62 detects the presence of the sheet (step S14), the pulse counter 73 counts the number of pulses outputted to the feedback stepping motor 55 by the feedback stepping motor driving circuit 70 after the sensor 62 detects the presence of the sheet.

After the feedback stepping motor driving circuit 70 has outputted the predetermined number of pulses to the feedback stepping motor 55, that is, just before the sheet enters the sheet feed rollers 42-2, the driving circuit 75 is caused to switch the driving current for the stepping motor 60 from the above normal current value I0 to the maximum current value I1 (second current value) to rotatively drive the stepping motor 60 (step S15). With this, the stepping motor 60 has its torque increased to a value required when the sheet enters the sheet feed rollers 42-2. Then, when the sensor 62 detects the absence of the sheet with the sheet nipped between the sheet feed rollers 42-2 (step S16), the driving circuit 75 is caused to switch the driving current for the stepping motor 60 from the maximum current value I1 to the normal current value I0 to rotatively drive the stepping motor 60 (step S17).

As described above, according to the present embodiment, after the start of conveying a sheet, the feedback stepping motor 55 and the stepping motor 60 are driven at the normal current value I0 (first current value), and after the sheet passes the sheet feed rollers 42-1 and just before the sheet enters the sheet feed rollers 42-2, the driving current for the stepping motor 60 is switched from the normal current value I0 to the maximum current value I1 (second current value), and then when the sensor 62 detects the absence of the sheets with the sheet completely nipped between the sheet feed rollers 42-2, the driving current for the stepping motor 60 is switched from the maximum current value I1 to the normal current value I0.

As a result of the above-described control, it is possible to set an optimal current value without setting the maximum current value for each type of as in the prior art, so as to prevent the stepping motor 60 from getting out of synchronism. Moreover, since the current value can be set in the optimal timing in which torque is applied to the stepping motor 60, it is possible to control a value of current flowing to the stepping motor 60 with high efficiency.

Moreover, even when an irregular type of sheet is fed, for example, from the manual feed tray 37 or the like in the image forming apparatus, it is not necessary to set the driving current for each stepping motor to a value that is considered to be required when the maximum load is applied to the stepping motor.

Furthermore, according to the above-described control, the stepping motors 60 can be used for all motors except for the feedback stepping motor 55 for driving the sheet feed rollers 42-1 located most upstream out of the plurality of sheet feed rollers. As a result, it is possible to realize an inexpensive construction.

Furthermore, the above-described embodiment is directed to the case where the motor control of the present invention is applied to the sheet rollers 42 by way of example. However, the present invention is not limited to this but the motor control method of the present invention is applicable also to the sheet feed rollers 38, 39.

In addition, a DC motor may be used for performing the feedback control of the driving current in place of the feedback stepping motor 55.

The above-described embodiment is directed to the case where the motor control method of the present invention is applied to a copier by way of example. However, the present invention is not limited to this but the motor control method of the present invention is applicable also to a multifunction apparatus or a printer.

It is to be understood that the object of the present invention may also be accomplished by supplying a system or an apparatus with a storage medium in which a program code of software which realizes the functions of the above described embodiment is stored, and causing a computer (or CPU or MPU) of the system or apparatus to read out and execute the program code stored in the storage medium.

In this case, the program code itself read from the storage medium realizes the functions of the embodiment described above, and hence the program code and the storage medium in which the program code is stored constitute the present invention.

Examples of the storage medium for supplying the program code include a floppy (registered trademark) disk, a hard disk, a magnetic-optical disk, an optical disk including a CD-ROM, a CD-R, a CD-RW, a DVD-ROM, a DVD-RAM, a DVD-RW, and a DVD+RW, a magnetic tape, a nonvolatile memory card, and a ROM. Alternatively, the program may be downloaded via a network.

Further, it is to be understood that the functions of the above described embodiment may be accomplished not only by executing a program code read out by a computer, but also by causing an OS (operating system) or the like which operates on the computer to perform a part or all of the actual operations based on instructions of the program code.

Further, it is to be understood that the functions of the above described embodiment may be accomplished by writing a program code read out from the storage medium into a memory provided on an expansion board inserted into a computer or in an expansion unit connected to the computer and then causing a CPU or the like provided in the expansion board or the expansion unit to perform a part or all of the actual operations based on instructions of the program code.

The form of the program may be an object code, a program code executed by an interpreter, or script data supplied to an OS (operating system).

CROSS REFERENCE TO RELATED APPLICATION

This application claims priority from Japanese Patent Application No. 2004-271654 filed Sep. 17, 2004, which is hereby incorporated by reference herein.

What is claimed is:

1. An image forming apparatus comprising:

an image forming unit that forms an image on a sheet;

a sheet conveying path;

a first motor for driving a first roller located on the sheet conveying path, said first roller conveying a sheet;

a second motor for driving a second roller located at a location downstream of said first roller on said sheet conveying path, said second roller conveying the sheet conveyed by said first rooler;

a first detecting device that detects a rotation of said first motor;

a first control device that controls a driving current value for said first motor in accordance with a detection result of said first detecting device;

a second detecting device that detects a maximum current value required by said first motor to drive said first roller when the sheet is conveyed by said first roller; and a second control device that controls a driving current value for said second motor in accordance with the maximum current value detected by said second detecting device.

2. An image forming apparatus as claimed in claim 1, wherein said second control device switches the driving current value for said second motor from the value according to the maximum current value to a value for said second motor from the value according to the maximum current value to a value according to a normal current value that is lower than the maximum current value at a predetermined time point after setting the driving current value for said second motor to the value according to the maximum current value.

3. A motor control apparatus comprising:

a first motor for driving a first roller located on a sheet conveying path, said first roller conveying a sheet;

a second motor for driving a second roller located at a location downstream of said first roller on said sheet conveying path, said second roller conveying the sheet conveyed by said first roller;

a first detecting device that detects a rotation of said first motor;

a first control device that controls a driving current value for said first motor in accordance with a detection result of said first detecting device;

a second detecting device that detects a maximum current value required by said first motor to drive said first roller when the sheet is conveyed by said first roller; and a second control device that controls a driving current value for said second motor in accordance with the maximum current value detected by said second detecting device.

4. A motor control apparatus as claimed in claim 3, wherein said second control device switches the driving current value for said second motor from the value according to the maximum current value to a value according to a normal current value that is lower than the maximum current value at a predetermined time point after setting the driving current value for said second motor to the value according to the maximum current value.

5. A motor control apparatus as claimed in claim 4, further comprising:

a sheet detecting device that is disposed between said first roller and said second roller, for detecting presence or absence of a sheet; and wherein said control device switches the driving current value for said second motor from a value according to the normal current value to the value according to the maximum current value upon lapse of a predetermined time interval after said sheet detecting device detects the presence of the sheet, and switches the driving current value for said second motor from the value according to the maximum current value to the value according to the normal current value when said sheet detecting device detects the absence of the sheet while the sheet is nipped between said second roller.

6. A motor control apparatus as claimed in claim 5, further comprising a time counting device that counts time, and wherein the predetermined time interval is a predetermined time period counted by said time counting device after said sheet detecting device detects the presence of the sheet.

7. A motor control apparatus as claimed in claim 5, further comprising a pulse counting device that counts a number of pulses outputted to said first motor, and wherein the predetermined time interval is a time interval after said sheet detecting device detects the presence of the sheet and until a predetermined number of pulses outputted to said first motor are counted by said pulse counting device.

8. A motor control apparatus as claimed in claim 3, wherein said first motor is a feedback stepping motor and said second motor is a non-feedback stepping motor.

9. A motor control apparatus as claimed in claim 3, further comprising a current detecting device that detects a current flowing to said first motor when the sheet enters said first roller, and wherein the value according to the maximum current value is a current value detected by said current detecting device.

10. A motor control apparatus as claimed in claim 3, wherein said first detecting device detects a rotor position of said first motor.

* * * * *